US008820865B2

(12) United States Patent
Simpson et al.

(10) Patent No.: US 8,820,865 B2
(45) Date of Patent: Sep. 2, 2014

(54) RECESSED SHELF AND DRAWER SUPPORT FOR REFRIGERATOR

(75) Inventors: Cory Dale Simpson, Abbeville, SC (US); Nilton Carlos Bertolini, Anderson, SC (US)

(73) Assignee: Electrolux Home Products, Inc., Charlotte, NC (US)

( * ) Notice: Subject to any disclaimer, the term of this patent is extended or adjusted under 35 U.S.C. 154(b) by 123 days.

(21) Appl. No.: 13/203,408

(22) PCT Filed: Feb. 26, 2010

(86) PCT No.: PCT/US2010/025624

§ 371 (c)(1), (2), (4) Date: Nov. 7, 2011

(87) PCT Pub. No.: WO2010/099467

PCT Pub. Date: Sep. 2, 2010

(65) Prior Publication Data

US 2012/0043874 A1 Feb. 23, 2012

Related U.S. Application Data

(60) Provisional application No. 61/156,178, filed on Feb. 27, 2009.

(51) Int. Cl.
*A47B 96/04* (2006.01)
*F25D 23/06* (2006.01)

(52) U.S. Cl.
CPC ..... *F25D 23/067* (2013.01); *F25D 2323/021* (2013.01)
USPC ..... 312/408; 312/410; 108/108

(58) Field of Classification Search
USPC ..... 312/408, 410; 108/106–108, 110
See application file for complete search history.

(56) References Cited

U.S. PATENT DOCUMENTS

| | | | | |
|---|---|---|---|---|
| 3,261,585 | A * | 7/1966 | Costantini et al. | 248/243 |
| 4,570,390 | A * | 2/1986 | Wendt | 52/36.6 |
| 4,779,939 | A * | 10/1988 | Stich | 312/405 |
| 5,004,302 | A * | 4/1991 | Stocking et al. | 312/408 |
| 5,769,520 | A * | 6/1998 | Jun et al. | 312/408 |
| 8,123,315 | B2 * | 2/2012 | Hagele et al. | |
| 2003/0117051 | A1 * | 6/2003 | Kweon | 312/408 |
| 2006/0163985 | A1 * | 7/2006 | Blersch et al. | 312/408 |
| 2008/0030114 | A1 * | 2/2008 | Becke | 312/408 |
| 2008/0048540 | A1 * | 2/2008 | Kim | 312/408 |

FOREIGN PATENT DOCUMENTS

| | | |
|---|---|---|
| DE | 202004017125 | 3/2006 |
| DE | 102006014374 | 10/2007 |
| DE | 102007005949 | 8/2008 |
| EP | 1443292 | 8/2004 |
| SU | 1370393 | 1/1988 |

OTHER PUBLICATIONS

International Search Report for PCT/US2010/025624, dated Nov. 3, 2010, 3 pages.

* cited by examiner

*Primary Examiner* — Hanh V Tran
(74) *Attorney, Agent, or Firm* — Pearne & Gordon LLP

(57) ABSTRACT

Provided is a refrigeration appliance (2) that includes a fresh food compartment (8) and a freezer compartment (4). A refrigerator liner (14) is located within the fresh food compartment. The liner includes one or more recesses for receiving brackets (10). Each bracket may be removably inserted into a recess (12) such that when the bracket is inserted into the recess, the bracket and recess form a substantially planar plane across the liner.

10 Claims, 6 Drawing Sheets

RECESSED SHELF AND DRAWER SUPPORT FOR REFRIGERATOR

CROSS-REFERENCE TO RELATED APPLICATIONS

This application claims the benefit of U.S. Provisional Application No. 61/156,178, filed Feb. 27, 2009, which is incorporated in its entirety herein by reference.

FIELD OF THE INVENTION

The present invention relates generally to refrigerators, and more particularly to brackets mounted to a liner in the fresh food compartment of refrigerators.

BACKGROUND OF THE INVENTION

Refrigerators and refrigerator liners are known and used in many different applications. Refrigerators include an outer shell, a liner, and insulation between the two. The liner often forms the interior refrigerator compartment and may include brackets, shelving, and drawers. Brackets may be mounted to the refrigerator liners within the fresh food compartment allowing for shelves, drawers, etc. to be secured to the brackets. Furthermore, foam fixtures are commonly used to add insulating foam to a refrigerator between the refrigerator liner and the outer metal shell. In one example, foam insulation is first inserted between the liner and shell and only after that are the brackets and other interior hardware secured to the refrigerator liner. This method had the advantage of having the refrigerator liner comprise a planar surface, making foam insertion easier. Securing the brackets to the liner, however, was difficult because the foam was already in place. Furthermore, the brackets attached to the liner after foaming extended into the interior of the fresh food compartment and consumed usable volume within that compartment. The brackets also imparted a shearing force on the fasteners that secured the brackets to the liner, limiting the maximum static load that the shelves could handle. If the brackets are inserted prior to foaming, then the foam fixture requires a special design to mirror the contour of the liner and to accommodate for the brackets protruding into the compartment. Thus, there is a continuing need for a refrigerator liner that accommodates brackets that consume less volume within the fresh food compartment, form a substantially planar surface with the liner, and are attachable before foaming occurs.

BRIEF SUMMARY OF THE INVENTION

The following presents a simplified summary of the invention in order to provide a basic understanding of some example aspects of the invention. This summary is not an extensive overview of the invention. Moreover, this summary is not intended to identify critical elements of the invention nor delineate the scope of the invention. The sole purpose of the summary is to present some concepts of the invention in simplified form as a prelude to the more detailed description that is presented later.

In accordance with one aspect of the present invention, a refrigeration appliance is provided, comprising a freezer compartment maintained at a temperature of zero degrees Centigrade or less and a fresh food compartment maintained at a temperature greater than zero degrees Centigrade, a liner located within the fresh food compartment, at least one recess integrally formed in the liner, wherein the recess includes at least one aperture extending through the liner, and a bracket for removable insertion into the recess, wherein the bracket includes a front edge, a back edge, and a side edge, wherein the back edge includes at least one mounting hole configured to align with the at least one aperture when the bracket is inserted into the recess, wherein the side edge is rounded to form an arcuate corner, and wherein the front edge and liner form a substantially planar plane when the bracket is inserted into the recess.

BRIEF DESCRIPTION OF THE DRAWINGS

The foregoing and other aspects of the present invention will become apparent to those skilled in the art to which the present invention relates upon reading the following description with reference to the accompanying drawings, in which.

DETAILED DESCRIPTION OF THE INVENTION

Figure 1:
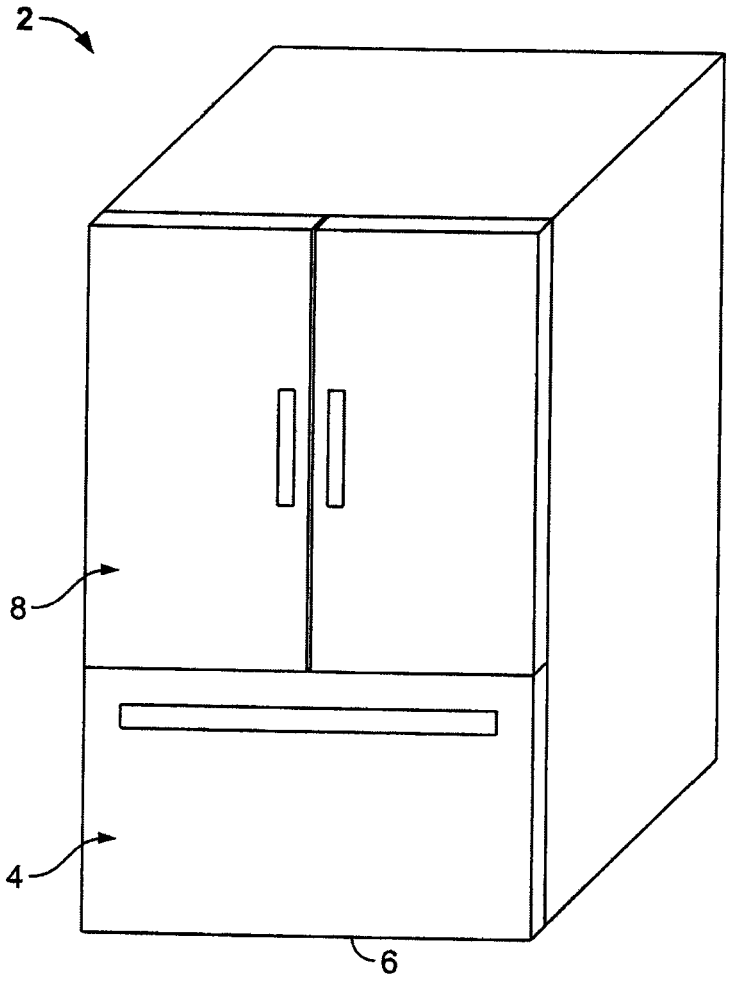
FIG. 1 illustrates a perspective view of an example refrigerator.

Example embodiments that incorporate one or more aspects of the present invention are described and illustrated in the drawings. These illustrated examples are not intended to be a limitation on the present invention. For example, one or more aspects of the present invention can be utilized in other embodiments and even other types of devices. Moreover, certain terminology is used herein for convenience only and is not to be taken as a limitation on the present invention. Still further, in the drawings, the same reference numerals are employed for designating the same elements.

Turning to the shown example of FIG. 1, there is shown a refrigerator 2. The refrigerator includes a freezer compartment 4 located in the lower portion of the refrigerator 2. The freezer compartment 4 may be accessed through a bottom mounted pull-out freezer door 6. The freezer compartment 4 is used to freeze and/or maintain food articles stored within. The freezer compartment 4 may be maintained at a temperature at or below zero degrees Centigrade. The upper portion of the refrigerator includes a fresh food compartment 8. The fresh food compartment 8 may be accessed through double doors, also known as French doors. The fresh food compartment 8 is used to keep food articles fresh and maintain them at a temperature near and above zero degrees Centigrade.

In addition to being used with the refrigerator appliance shown in FIG. 1, the present invention may be employed with various types of domestic refrigerator configurations. For instance, the present invention may be used with a refrigerator that has a freezer compartment located in the upper portion of the refrigerator with the fresh food compartment located in the lower portion of the refrigerator. Similarly, the present invention may be used in a side-by-side refrigerator where the freezer compartment is located next to and on the side of the fresh food compartment.

Figure 2:
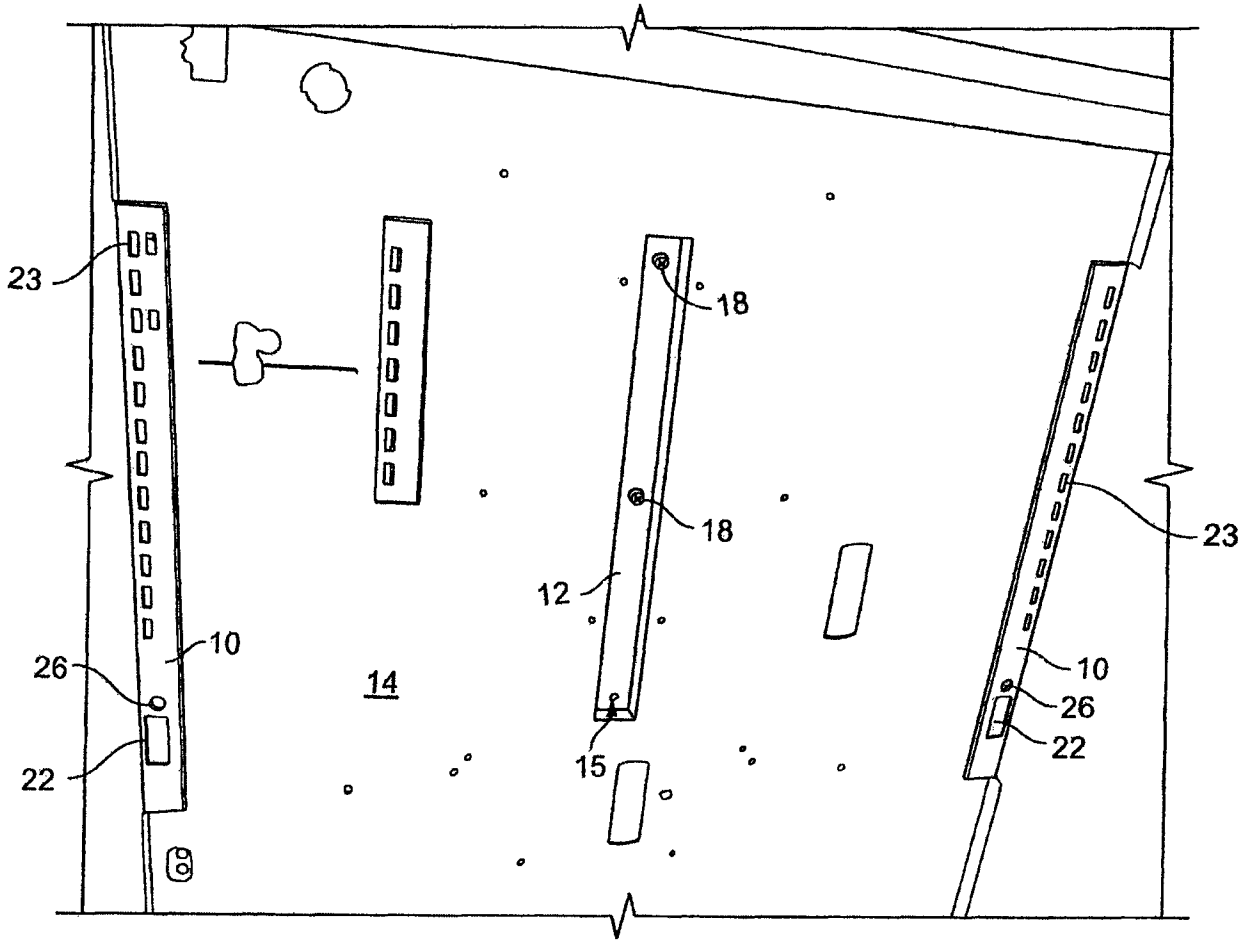
FIG. 2 illustrates a perspective view of an example refrigerator interior showing a liner.

Turning to the shown example of FIG. 2, there is shown the interior of the fresh food compartment 8 of the refrigerator 2. The interior includes a liner 14 having a plurality of recesses 12. In FIG. 2, only a recess 12 in the center is shown. Brackets 10 are shown inserted in each of the side recesses 12. Each recess 12 is comprised of an elongated, vertical indentation formed within the liner 14 along with a plurality of apertures 15 formed in the back of the recess 12. Each aperture 15 is large enough to accommodate the insertion of a shoulder screw 18. The recesses 12 may be arranged vertically within the liner 14 and a recess 12 may be arranged at each end of the liner 14. There may be further recesses 12, such as in the center in FIG. 2, arranged in the liner 14. There also may be recesses 12 of varying length within the liner 14.

Figure 3:
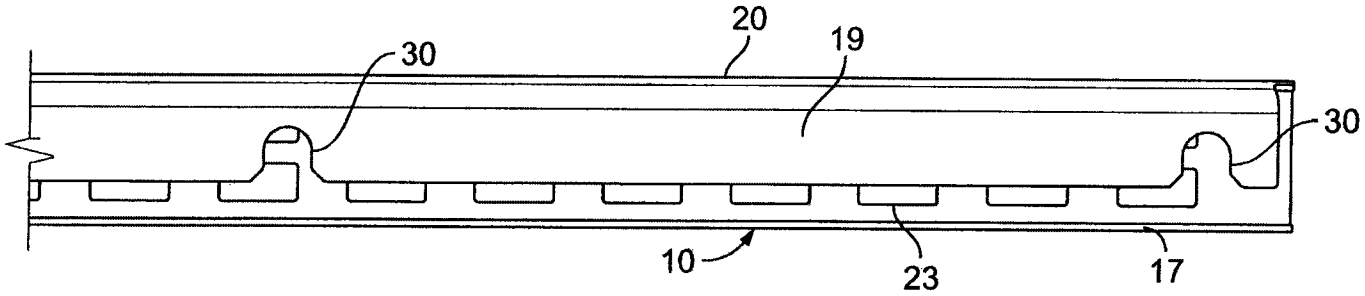
FIG. 3 illustrates a side view of an example refrigerator bracket.
Figure 4:
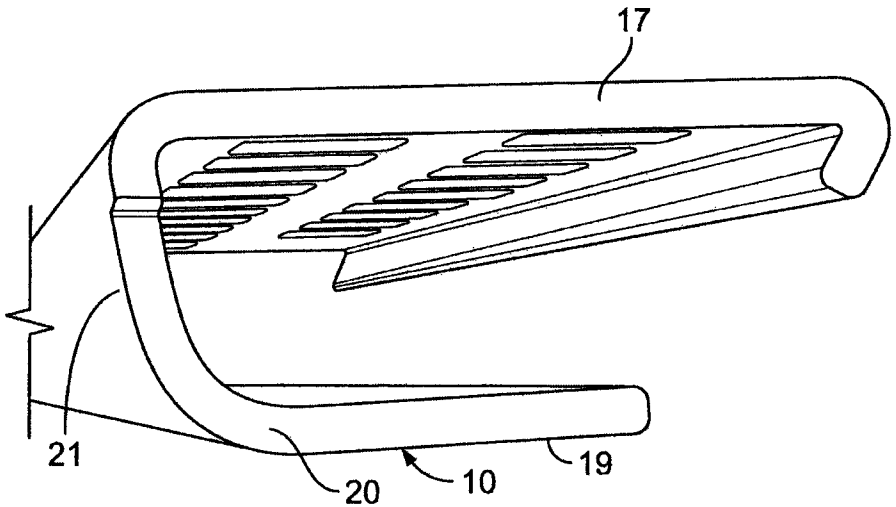
FIG. 4 illustrates an end view of the example refrigerator bracket.

Turning to the shown examples of FIGS. 3 and 4, there is shown a side view of a bracket 10 designed for insertion into a recess 12 within the liner 14. The bracket 10 is elongated, substantially straight and may have an arcuate corner 20. As seen more clearly in FIG. 4, the arcuate corner 20 is a rounded edge that provides the manufacturer with a comfortable design tolerance allowing the bracket 10 to be inserted into the recess 12. The bracket 10 may also include front 17, back 19 and side 21 edges. Along the front edge 17, the bracket 10 may include a plurality of openings 23 arranged vertically. In the shown example, the openings 23 are rectangular, though they may comprise a variety of shapes, including circular openings, square openings, etc. Similarly, the openings 23 may extend in a single column or may comprise multiple columns arranged side by side. Even further, the bracket 10 may include one or more apertures 22 formed at an end of the bracket 10, as shown in FIG. 2. The apertures 22 may be larger than the openings 23 but may comprise a variety of sizes and shapes, including a square aperture, a circular aperture, an oval aperture, etc. The apertures 22 may also be formed at either one or both ends of the bracket 10. The openings 23 are adapted to receiving one or more mounting structures, such as shelves, covers, or the like. In the shown examples of FIGS. 6 and 7, for instance, the openings 23 are shown supporting a shelf. The front edge 17 of the bracket 10 may further include a receiving opening 26. The receiving opening 26 in the shown example is circular and formed near the aperture 22 at an end. However, the receiving opening 26 may comprise a variety of shapes and may be placed in varying locations on the bracket 10.

Referring now to the back edge 19 in FIG. 3, the bracket 10 may include mounting holes 30. These holes 30 may either be bounded on all four sides, or be surrounded on three sides to provide an open side along a perimeter of the back edge, as in the shown example. The holes 30 in the shown example are circular and are large enough to accommodate the insertion of the shoulder screw 18. The holes 30 may be formed vertically along the bracket 10. When the bracket 10 is inserted within the recess 12, the mounting holes 30 are designed to match up with the apertures 15 of the liner 14.

Figure 5:
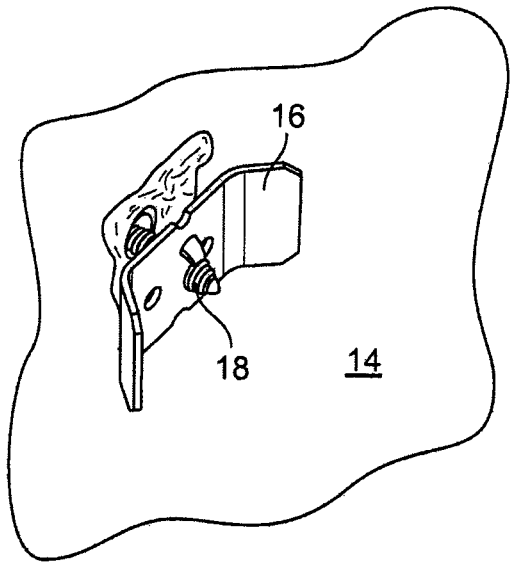
FIG. 5 illustrates a rear view of the liner within the refrigerator.

Turning to the shown example of FIG. 5, there is shown an anchor nut 16 and shoulder screw 18 protruding from the rear side of the liner 14. The anchor nut 16 and shoulder screw 18 assist in securing the bracket 10 within the recess 12 to the liner 14. As mentioned, the bracket 10 is insertable into a recess 12 of the refrigerator liner 14. Furthermore, the bracket 10 includes mounting holes 30 that match up with the apertures 15 of the liner 14. Each mounting hole 30 and aperture 15 is designed to accommodate the insertion of a shoulder screw 18. The shoulder screws 18 pass through the bracket 10 and through the aperture 15 in the liner 14. Each shoulder screw 18 has a head portion that is larger than both the mounting hole 30 and aperture 15. Each shoulder screw 18 is inserted such that the head portion is secured flush against the mounting hole 30 of the bracket inside the refrigerator compartment 2 in the liner 14. Consequently, the threaded portion of the shoulder screw 18 protrudes through the back of the liner 14, as shown in FIG. 5. The anchor nut 16 is designed to fit over the threaded portion and hold the shoulder screw 18 in place. In one embodiment, the anchor nut 16 may screw onto the shoulder screw 18 to hold the shoulder screw 18 in place. In another embodiment, the anchor nut 16 may slide over the threaded portion of the shoulder screw 18 with a separate nut screwing onto the threaded portion.

The anchor nut 16 may include an adhesive to the side facing the liner 14. Alternatively, the adhesive may be applied to the back of the liner 14 a shown in FIG. 5. The adhesive acts to secure the anchor nut to the back of the liner 14 prior to the insertion of the shoulder screw 18. Once the anchor nut is secured to the liner 14, the shoulder screw 18 may be inserted through the aperture 15. The shoulder screw may then be screwed in with the anchor nut 16. Next, the bracket 10 may be inserted into the recess 12. The bracket is rotated on its long axis and pushed into the recess 12 so that the heads of the shoulder screws 18 engage the mounting holes 30 of the bracket. The arcuate corner 20 of the bracket 10 allows for an easier insertion as the bracket 10 may slide and be pushed into the recess 12.

Referring back to FIG. 2, there is shown the refrigerator liner 14 with brackets 10 inserted into the recesses 12 at the edges. The brackets 10 are secured to the liner 14 by the shoulder screw 18 and anchor nut 16. When inserted into the liner 14, the brackets 10 are shaped to fit such that the front edge 17 of the brackets 10 is flush with the exposed surface of the liner 14. Therefore, the back wall of the fresh food compartment 8 has a substantially planar appearance.

Figure 6:
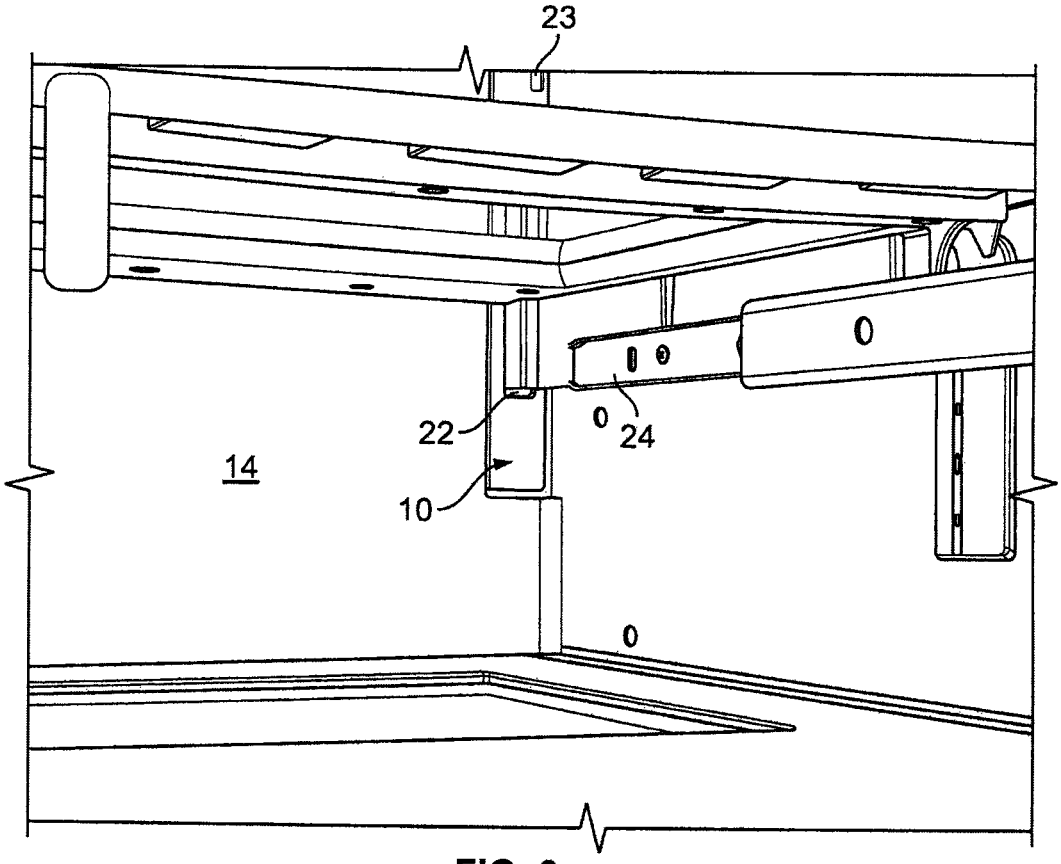
FIG. 6 illustrates an underneath view of an example mounted shelf.

As seen more clearly in FIG. 6, the apertures 22 formed in the brackets 10 may be located towards the bottom of the brackets 10 with a bracket 10 at each lateral side of the liner 14. Each aperture 22 is configured to hold a drawer slide 24. The drawer slide 24 may include an attached drawer, crisper, etc., allowing for a user to slide the drawer or crisper in and out of the fresh food compartment 8. The drawer is opened at the top, allowing a user to place items inside, such as fruits, vegetables, etc. Thus, the drawer may extend laterally across the fresh food compartment 8 attached to the two drawer slides 24. In another embodiment, a bracket 10 may be inserted into the center recess 12 and have a bottom aperture 22. In such a case, a drawer slide 24 may attach to the center bracket 10 allowing for a total of three drawer slides 24. Consequently, the fresh food compartment 8 may then have more than one drawer, crisper, etc. The brackets 10 also include the circular receiving opening 26 which is located above the aperture 22.

Figure 7:
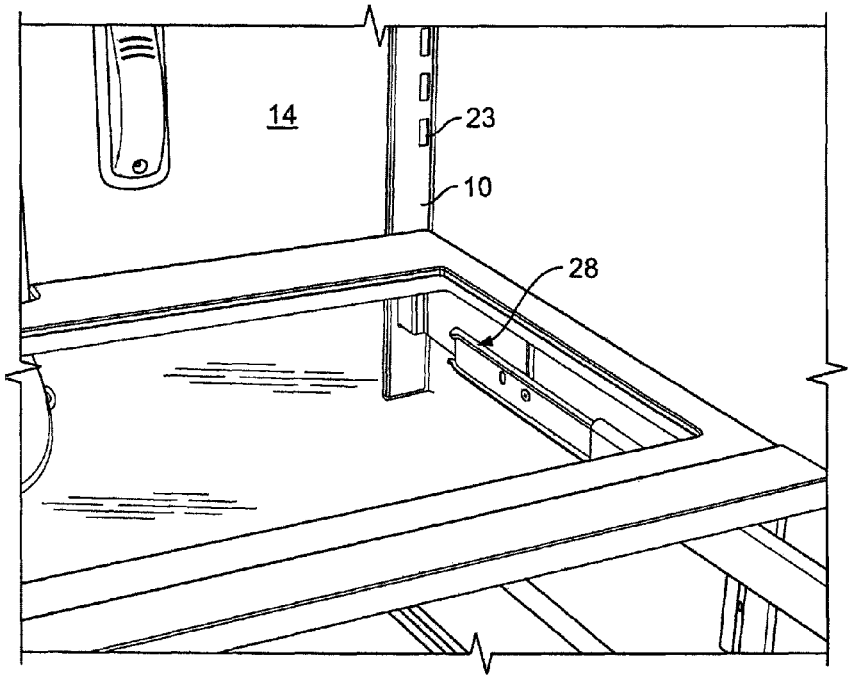
FIG. 7 illustrates a perspective view of the mounted shelf.

As shown in FIG. 7, the circular receiving opening 26 may be configured to hold a cover 28 for covering the drawer. Thus, when the drawer and drawer slide 24 are pushed in completely, they will be covered. When a user retracts the drawer, the drawer slide 24 slides out away from the liner 14 while the cover 28 remains stationary and attached to the receiving opening 26. The drawer will then be uncovered at the top, providing access to the interior items. The cover 28 may extend laterally across the fresh food compartment 8 being attached to the receiving openings 26 of two brackets 10.

Figure 8:
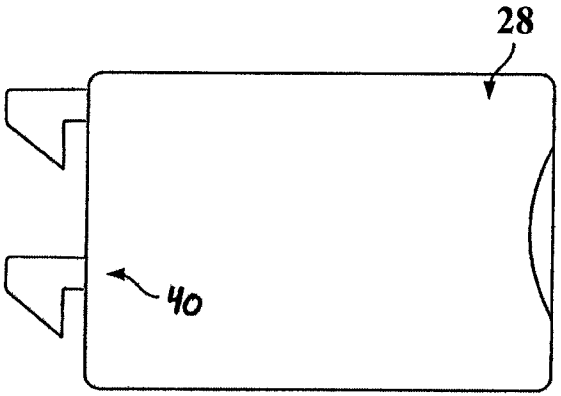
FIG. 8 illustrates a perspective view of an example cover attaching means.

As shown in FIG. 8, the cover 28 is shown with an attachment means 40 for securing to the bracket 10. As mentioned, the cover 28 may be secured along with the drawer slide 24 to the bracket 10. In the shown example, the attachment means 40 includes two downwardly facing hooks. The upper hook may be inserted into the circular receiving opening 26 while the lower hook may be inserted into the aperture 22. The cover 28 may be secured to the drawer slide 24 allowing for the attachment means 40 to secure both the cover 28 and drawer slide 24 to the bracket 10. The attachment means 40 may comprise a number of different embodiments, however. For instance, the attachment means 40 may include an upper hook that is downwardly facing while the lower hook is merely inserted into the aperture 22. In yet another embodiment, the hooks may face the same direction and be flexed to allow for insertion.

The function of the invention will now be discussed. The liner 14 forming the interior of the fresh food compartment 8 may be formed of any number of materials, including plastic, etc. The liner 14 is placed within an outer metal shell. Thus, there may be a gap between the outside of the liner 14 and the inside of the outer metal shell providing for the insertion of insulating foam. As mentioned, each anchor nut 16 may be equipped with an adhesive to secure it to the back of the liner 14. The adhesive holds the anchor nut 16 in place as the shoulder screw 18 is inserted through the apertures 15. After the shoulder screw 18 is inserted, the brackets 10 may be rotated along their long axis and pushed into the recesses 12 and secured into place with shoulder screws 18 and anchor nut 16 assemblies. The shoulder screws 18 will engage the mounting holes 30 of the brackets 10. Next, foam may be inserted into the fresh food compartment 8 between the liner 14 and outer shell. To accomplish this, a foam fixture is used. The foam fixture holds the liner during the foaming process and prevents the liner from being pushed in or deformed by the inserted foam. The foam fixture faces the interior of the fresh food compartment 8 with the brackets 10 flush with the liner 14. The flat planar surface of the liner 14 may reduce the need for a foam fixture that mirrors the inner contour of the liner 14. Thus, the foam fixture may be generally flat. Thus, the foam fixture can be generally flat and placed flush over the inside of the liner 14 and brackets together. Foam may then be inserted between the liner 14 and outer shell. The anchor nut 16 becomes embedded in the foam as it secures the shoulder screw 18. Lastly, with the brackets 10 already secured within the recesses 12, the foam may be given time to cure.

The invention has been described with reference to the example embodiments described above. Modifications and alterations will occur to others upon a reading and understanding of this specification. Examples embodiments incorporating one or more aspects of the invention are intended to include all such modifications and alterations insofar as they come within the scope of the appended claims.

What is claimed is:

1. A refrigeration appliance comprising:

a freezer compartment maintained at a temperature of zero degrees Centigrade or less and a fresh food compartment maintained at a temperature greater than zero degrees Centigrade;

a liner located within the fresh food compartment;

at least one recess integrally formed in the liner, wherein the recess includes at least one aperture extending through the liner;

a bracket for removable insertion into the recess, wherein the bracket includes a front edge, a back edge, and a side edge, wherein the back edge includes at least one mounting hole configured to align with the at least one aperture when the bracket is inserted into the recess, wherein the side edge is rounded to form an arcuate corner, and wherein the front edge and liner form a substantially planar plane when the bracket is inserted into the recess; and a fastener having a head, wherein the fastener is configured to be inserted into the at least one aperture in the liner and received within the mounting hole of the bracket to secure the bracket in the recess, further wherein the mounting hole of the bracket is partially bounded such that the mounting hole has an open side provided along a perimeter of the back edge and is configured such that the fastener is received within the mounting hole by rotating the bracket along a longitudinal axis of the bracket.

2. The refrigeration appliance of claim 1, wherein the front edge of the bracket includes a plurality of openings.

3. The refrigeration appliance of claim 2, further including a mounting structure adapted to be held by the plurality of openings in the front edge.

4. The refrigeration appliance of claim 1, wherein the at least one recess is oriented vertically in the liner.

5. The refrigeration appliance of 1, wherein the at least one recess comprises three recesses.

6. A refrigeration appliance comprising:

a freezer compartment maintained at a temperature of zero degrees Centigrade or less and a fresh food compartment maintained at a temperature greater than zero degrees Centigrade;

a liner located within the fresh food compartment;

at least one recess integrally formed in the liner, wherein the recess includes at least one aperture extending through the liner;

a bracket for removable insertion into the recess, wherein the bracket includes a front edge, a back edge, and a side edge, wherein the back edge includes at least one mounting hole configured to align with the at least one aperture when the bracket is inserted into the recess, wherein the side edge is rounded to form an arcuate corner, and wherein the front edge and liner form a substantially planar plane when the bracket is inserted into the recess; and a fastener having a head, wherein the fastener is configured to be inserted into the at least one aperture in the liner and received within the mounting hole of the bracket to secure the bracket in the recess, further wherein a perimeter of the mounting hole is partially bounded such that the mounting hole has an open side for receiving the fastener, wherein the open side of the mounting hole is provided along a perimeter of the back edge.

7. The refrigeration appliance of claim 6, wherein the front edge of the bracket includes a plurality of openings.

8. The refrigeration appliance of claim 7, further including a mounting structure adapted to be held by the plurality of openings in the front edge.

9. The refrigeration appliance of claim 6, wherein the at least one recess is oriented vertically in the liner.

10. The refrigeration appliance of 6, wherein the at least one recess comprises three recesses.

* * * * *